US007012054B2

(12) United States Patent
Binder et al.

(10) Patent No.: US 7,012,054 B2
(45) Date of Patent: Mar. 14, 2006

(54) SOFTENING LAUNDRY DETERGENT

(75) Inventors: David Alan Binder, Saddle Brook, NJ (US); Dennis Stephen Murphy, Wyckoff, NJ (US); Michael Orchowski, East Rutherford, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 90 days.

(21) Appl. No.: 10/727,234

(22) Filed: Dec. 3, 2003

(65) Prior Publication Data

US 2005/0124528 A1 Jun. 9, 2005

(51) Int. Cl.

| | |
|---|---|
| ***C11D 1/02*** | (2006.01) |
| ***C11D 1/38*** | (2006.01) |
| ***C11D 3/37*** | (2006.01) |
| ***B08B 3/04*** | (2006.01) |

(52) U.S. Cl. ..... 510/327; 510/329; 510/360; 510/361; 510/384; 510/426; 510/434; 510/476; 510/492; 510/499; 8/137

(58) Field of Classification Search ..... 510/327, 510/329, 360, 361, 384, 426, 434, 476, 492, 510/499; 8/137

See application file for complete search history.

(56) References Cited

U.S. PATENT DOCUMENTS

| | | | | |
|---|---|---|---|---|
| 3,472,840 | A | 10/1969 | Stone et al. | |
| 4,144,226 | A | 3/1979 | Crutchfield et al. | |
| 4,146,495 | A | 3/1979 | Crutchfield et al. | |
| 4,299,817 | A | 11/1981 | Hannan, III et al. | |
| 4,686,062 | A | 8/1987 | Kermode et al. | |
| 4,844,821 | A | 7/1989 | Mermelstein et al. | |
| 4,913,828 | A | 4/1990 | Caswell et al. | |
| 5,073,274 | A | 12/1991 | Caswell | |
| 5,863,880 | A | 1/1999 | Shih et al. | |
| 6,046,152 | A | 4/2000 | Vinson et al. | |
| 6,369,018 | B1 | 4/2002 | Hsu et al. | |
| 6,461,387 | B1 | 10/2002 | Jureller et al. | |
| 6,492,322 | B1 | 12/2002 | Cooper et al. | |
| 6,528,477 | B1 | 3/2003 | Kasturi et al. | |
| 6,616,705 | B1 * | 9/2003 | Kischkel et al. | 8/137 |
| 6,620,209 | B1 | 9/2003 | Kischkel et al. | |
| 2002/0055451 | A1 | 5/2002 | Kischkel et al. | |
| 2002/0058604 | A1 | 5/2002 | Kischkel et al. | |
| 2002/0151454 | A1 * | 10/2002 | Kischkel et al. | 510/466 |
| 2003/0186832 | A1 | 10/2003 | Padron et al. | |

FOREIGN PATENT DOCUMENTS

| | | |
|---|---|---|
| EP | 0 786 517 | 7/1997 |
| EP | 0 997 525 | 5/2000 |
| EP | 0 997 526 | 5/2000 |
| EP | 1 188 817 | 3/2002 |
| GB | 2 172 299 | 9/1986 |
| WO | 98/04239 | 2/1998 |
| WO | 98/04241 | 2/1998 |
| WO | 98/16538 | 4/1998 |
| WO | 00/70005 | 11/2000 |

OTHER PUBLICATIONS

Lockhead, R.Y., et al. *Encyclopedia of Polymers and Thickeners for Cosmetics, Cosmetics and Toiletries*, vol. 108, 95-138, (May 1993).

*International Cosmetic Ingredient Dictionary, Monographs*, 569-574.

Bluestein, B.R., et al., *Cationic Surfactants Organic Chemistry*, 52-53, (1982).

Rubingh, Donn N. et al., *Cationic Surfactants Physical Chemistry*, vol. 37, 2-5, 496-497, (1991).

Alco Chemical™ Technical Information ALCOSPERSE® 725 Product Description TB 3208 (2000).

Amjad, Zahid et al., *The Influence of Cationic Polymers on the Performance of Anionic Polymers as Precipitation Inhibitors for Calcium Phosphonates*, paper published in the Phosphorus Research Bulletin, vol. 12, 59-65, (2002). *Noveon.*

International Specialty Products printout "Performance Chemicals Reference Guide" Copyright© 2003.

*International Search Report, PCT/EP2004/013161; mailed Apr. 25, 2005, 4 pp.*

* cited by examiner

*Primary Examiner*—Brian P. Mruk
(74) *Attorney, Agent, or Firm*—Ellen Plotkin

(57) ABSTRACT

The present invention relates to fabric and textile conditioning compositions with improved particulate soil cleaning, containing particular combinations of cationic polymers and anionic surfactants in combination with a polyvinylpyrrolidone/amphiphilic carboxy containing polymer anti-redeposition system. The cationic polymers are preferably below a particular molecular weight to afford optimal cleaning and conditioning, and must be present in an effective amount to yield a substantial conditioning benefit. A method of conditioning articles using the inventive compositions is also disclosed.

20 Claims, No Drawings

SOFTENING LAUNDRY DETERGENT

FIELD OF THE INVENTION

This invention relates to laundry conditioning compositions. More particularly, the invention is directed to conditioning liquid laundry compositions with improved particulate soil cleaning.

BACKGROUND OF THE INVENTION

Traditionally, textile fabrics, including clothes, have been cleaned with laundry detergents, which provide excellent soil removal, but can often make garments feel harsh after washing. To combat this problem, a number of fabric. conditioning technologies, including rinse-added softeners, dryer sheets, and 2-in-1 detergent softeners, have been developed. 2-in-1 detergent softeners have normally been the most convenient of these technologies for consumers, but many of these existing technologies still have disadvantages. One of the more effective technologies for this type of product, systems comprising cationic, polymers, softens quite well but can contribute to soil deposition, hindering the cleaning performance of the detergent.

Anionic soil release and antiredeposition polymers are often used to improve cleaning, but normally, the amount of certain types of anionic polymers added to a fabric conditioning system including cationic polymers is minimized. It is believed, without wishing to be bound by theory, that anionic polymers can complex with the cationic polymers and have a detrimental effect on softening.

Softening laundry detergent compositions have been disclosed in published U.S. Pat. Nos. 6,616,705; 6,620,209; and 4,844,821.

Washer added fabric softening compositions have been disclosed in U.S. Pat. Nos. 4,913,828 and 5,073,274. Fabric softener compositions have been disclosed in WO 00/70005 and U.S. Pat. No. 6,492,322.

Lazare-Laporte, et al., European Patent No. EP 0 786 517 discloses a detergent composition including (a) surfactant material, (b) amphiphilic carboxy containing polymer, and (c) uncharged polymer. A process for producing suspending liquid laundry detergents has been disclosed in Hsu, U.S. Pat. No. 6,369,018. Hsu discloses the use of cationic cellulose ether (polymer JR) in an anionic surfactant containing liquid detergent and further requires a polysaccharide polymer such as xanthan gum. As optional, Hsu et al. describe soil release polymers in encapsulated form.

A need remains for softening laundry detergent compositions including cationic polymers for improved softening achieved through adding the compositions in the wash cycle of automatic washing machines, while avoiding soil redeposition. Surprisingly, we have found that certain anionic polymers are compatible with cationic fabric conditioning polymers, allowing the formulation of products that give excellent softening without compromising cleaning performance.

SUMMARY OF THE INVENTION

A conditioning liquid laundry composition with improved particulate soil cleaning comprising:

a. at least about 5% of at least one anionic surfactant;

b. about 0.01% to about 5% of at least one amphiphilic carboxy containing polymer, preferably, an anionic polyacrylate;

c. about 0.05% to about 3% of polyvinylpyrrolidone polymer (an uncharged polymer); and d. at least one cationic conditioning polymer.

Preferably, the inventive laundry composition has a Softening Parameter of greater than about 40, a delta E of less than about 12, and one or more of the cationic polymers has a molecular weight of less than about 850,000 daltons. More preferably, the inventive composition has a Softening Parameter of greater than about 70; most preferably, the Softening Parameter is greater than about 80, for maximum softening at the same cleaning capacity.

In another aspect, this invention is directed to a method for conditioning textiles comprising, in no particular order, the steps of:

a. providing a laundry detergent or fabric softener composition comprising at least one anionic surfactant and at least one cationic polymer, in a ratio and concentration to effectively soften and condition fabrics under predetermined laundering conditions;

b. contacting one or more articles with the composition at one or more points during a laundering process; and c. allowing the articles to dry or mechanically tumble-drying them.

Preferably, the amphiphilic carboxy containing polymer is an anionic polyacrylate polymer.

Cationic polymers include dimethyl diallyl ammonium chloride/acrylamide copolymer, dimethyl diallyl ammonium chloride/acrylic acid/acrylamide terpolymer, vinylpyrrolidone/methyl vinyl imidazolium chloride copolymer, polydimethyl diallyl ammonium chloride, starch hydroxypropyl trimmonium chloride, polymethacryl amidopropyl trimethyl ammonium chloride, acrylamidopropyl trimmonium chloride/acrylamide copolymer, guar hydroxypropyl trimonium chloride, hydroxyethyl cellulose derivatized with trimethyl ammonium substituted epoxide, and mixtures thereof.

DETAILED DESCRIPTION OF THE INVENTION

The present invention is directed to conditioning liquid laundry compositions which deliver both effective softening and effective particulate soil cleaning, including:

(a) at least about 5% of one or more anionic surfactant;

(b) of about 0.01% to about 5% of at least one amphiphilic carboxy containing polymer, preferably an anionic polyacrylate;

(c) about 0.05% to about 3% of polyvinylpyrrolidone (an uncharged polymer); and (d) one or more cationic polymers that deliver a high level of conditioning to fabrics.

The present invention is based on the surprising finding that certain cationic polymer and anionic surfactant mixtures provide excellent conditioning to laundered fabrics, while effectively preventing redeposition with inclusion of anionic polymer/polyvinylpyrrolidone anti-redeposition system. Preferably, the anionic polymer is an amphiphilic carboxy containing polymer.

In a preferred embodiment, the compositions of the present invention yield softening parameters of greater than about 70, a delta E of less than about 12, and one or more of the cationic polymers has a molecular weight of less than about 850,000 daltons. More preferably, the inventive composition has a delta E of less than about 7 and a Softening Parameter of greater than about 80, for maximum softening at a given cleaning capacity.

As used herein, the term "comprising" means including, made up of, composed of, consisting and/or consisting essentially of.

As used herein, the term "substantially free of precipitation" means that insoluble and substantially insoluble matter will be limited to less than about 10% of the composition, more preferably to about 5% or less.

Except in the operating and comparative examples, or where otherwise explicitly indicated, all numbers in this description indicating amounts or ratios of material or conditions of reaction, physical properties of materials and/or use are to be understood as modified by the word "about".

Anionic Surfactant

In order to attain the desired level of softening, with a Softening Parameter of greater than about 70, the inventive softening laundry compositions contain greater than about 5% anionic surfactant by weight of the composition.

The anionic surfactants used in this invention can be any anionic surfactant that is water soluble. "Water soluble" surfactants are, unless otherwise noted, here defined to include surfactants which are soluble or dispersible to at least the extent of 0.01% by weight in distilled water at 25° C. "Anionic surfactants" are defined herein as amphiphilic molecules with an average molecular weight of less than about 10,000, comprising one or more functional groups that exhibit a net anionic charge when in aqueous solution at the normal wash pH of between 6 and 11. It is preferred that at least one of the anionic surfactants used in this invention be an alkali or alkaline earth metal salt of a natural or synthetic fatty acid containing between 4 and 30 carbon atoms. It is especially preferred to use a mixture of carboxylic acid salts with one or more other anionic surfactants. Another important class of anionic compounds are the water soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Carboxylic Acid Salts $R^1COOM$ where $R^1$ is a primary or secondary alkyl group of 4 to 30 carbon atoms and M is a solubilizing cation. The alkyl group represented by $R^1$ may represent a mixture of chain lengths and may be saturated or unsaturated, although it is preferred that at least two thirds of the $R^1$ groups have a chain length of between 8 and 18 carbon atoms. Nonlimiting examples of suitable alkyl group sources include the fatty acids derived from coconut oil, tallow, tall oil and palm kernel oil. For the purposes of minimizing odor, however, it is often desirable to use primarily saturated carboxylic acids. Such materials are available from many commercial sources, such as Uniqema (Wilmington, Del.) and Twin Rivers Technologies (Quincy, Mass.). The solubilizing cation, M, may be any cation that confers water solubility to the product, although monovalent moieties are generally preferred. Examples of acceptable solubilizing cations for use with this invention include alkali metals such as sodium and potassium, which are particularly preferred, and amines such as triethanolammonium, ammonium and morpholinium. Although, when used, the majority of the fatty acid should be incorporated into the formulation in neutralized salt form, it is often preferable to leave a small amount of free fatty acid in the formulation, as this can aid in the maintenance of product viscosity.

Primary Alkyl Sulfates $R^2OSO_3M$ where $R^2$ is a primary alkyl group of 8 to 18 carbon atoms and M is a solubilizing cation. The alkyl group $R^2$ may have a mixture of chain lengths. It is preferred that at least two-thirds of the $R^2$ alkyl groups have a chain length of 8 to 14 carbon atoms. This will be the case if $R^2$ is coconut alkyl, for example. The solubilizing cation may be a range of cations which are in general monovalent and confer water solubility. An alkali metal, notably sodium, is especially envisaged. Other possibilities are ammonium and substituted ammonium ions, such as trialkanolammonium or trialkylammonium.

Alkyl Ether Sulfates $R^3O(CH_2CH_2O)_nSO_3M$ where $R^3$ is a primary alkyl group of 8 to 18 carbon atoms, n has an average value in the range from 1 to 6 and M is a solubilizing cation. The alkyl group $R^3$ may have a mixture of chain lengths. It is preferred that at least two-thirds of the $R^3$ alkyl groups have a chain length of 8 to 14 carbon atoms. This will be the case if $R^3$ is coconut alkyl, for example. Preferably n has an average value of 2 to 5. Ether sulfates have been found to provide viscosity build in certain of the formulations of this invention, and thus are considered a preferred ingredient.

Fatty Acid Ester Sulfonates $R^4CH(SO_3M)CO_2R^5$ where $R^4$ is an alkyl group of 6 to 16 atoms, $R^5$ is an alkyl group of 1 to 4 carbon atoms and M is a solubilizing cation. The group $R^4$ may have a mixture of chain lengths. Preferably at least two-thirds of these groups have 6 to 12 carbon atoms. This will be the case when the moiety $R^8CH(—)CO_2(—)$ is derived from a coconut source, for instance. It is preferred that $R^5$ is a straight chain alkyl, notably methyl or ethyl.

Alkyl Benzene Sulfonates $R^6ArSO_3M$ where $R^6$ is an alkyl group of 8 to 18 carbon atoms, Ar is a benzene ring ($C_6H_4$) and M is a solubilizing cation. The group $R^6$ may be a mixture of chain lengths. A mixture of isomers is typically used, and a number of different grades, such as "high 2-phenyl" and "low 2-phenyl" are commercially available for use depending on formulation needs. A plentitude of commercial suppliers exist for these materials, including Stepan (Northfield, Ill.) and Witco (Greenwich, Conn.) Typically they are produced by the sulfonation of alkylbenzenes, which can be produced by either the HF-catalyzed alkylation of benzene with olefins or an $AlCl_3$-catalyzed process that alkylates benzene with chloroparaffins, and are sold by, for example, Petresa (Chicago, Ill.) and Sasol (Austin, Tex.). Straight chains of 11 to 14 carbon atoms are usually preferred.

Paraffin sulfonates having 8 to 22 carbon atoms, preferably 12 to 16 carbon atoms, in the alkyl moiety. They are usually produced by the sulfoxidation of petrochemically-derived normal paraffins. These surfactants are commercially available as, for example, Hostapur SAS from Clariant (Charlotte, N.C.).

Olefin sulfonates having 8 to 22 carbon atoms, preferably 12 to 16 carbon atoms. U.S. Pat. No. 3,332,880 contains a description of suitable olefin sulfonates. Such materials are sold as, for example, Bio-Terge AS-40, which can be purchased from Stepan (Northfield, Ill.)

Sulfosuccinate Esters $$R^7OOCCH_2CH(SO_3^-M^+)COOR^8$$

are also useful in the context of this invention. $R^7$ and $R^8$ are alkyl groups with chain lengths of between 2 and 16 carbons, and may be linear or branched, saturated or unsaturated. A preferred sulfosuccinate is sodium bis (2-ethylhexyl)sulfosuccinate, which is commercially available under the tradename Aerosol OT from Cytec Industries (West Paterson, N.J.).

Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Other preferred anionic surfactants include the fatty acid ester sulfonates with formula:

$$R^9CH(SO_3M)CO_2R^{10}$$

where the moiety $R^9CH(—)CO_2(—)$ is derived from a coconut source and $R^{10}$ is either methyl or ethyl; primary alkyl sulfates with the formula:

$$R^{11}OSO_3M$$

wherein $R^{11}$ is a primary alkyl group of 10 to 18 carbon atoms and M is a sodium cation; and paraffin sulfonates, preferably with 12 to 16 carbon atoms to the alkyl moiety.

Other anionic surfactants preferred for use with this formulation include isethionates, sulfated triglycerides, alcohol sulfates, ligninsulfonates, naphthelene sulfonates and alkyl naphthelene sulfonates and the like.

Amphiphilic Carboxy Containing Polymer

The amphiphilic carboxy containing polymers according to the present invention are anioinic polymers, such as, preferably, polyacrylates. "Anionic polymer" is defined as a molecule with a molecular weight in excess of about 10,000 daltons comprised of monomer units where at least one of the monomer units making up the polymer contains a negative charge over a portion of the wash pH range of about 6 to about 11, and those monomer units not containing anionic charges being nonionic in nature.

The amphiphilic carboxy containing polymers comprise monomers comprising a carboxylate or carboxylic acid group, said monomers being preferably selected from carboxylated sugar units, carboxylated unsaturated units (like acrylate, methacrylate, itaconate, maleate and mixtures) and mixtures thereof. The amphiphilic carboxy containing polymer also contains monomer units which are uncharged. Preferably, these uncharged monomers are selected from vinylacetate, vinylpyrrolidone, vinylpyridine, vinylimidazol, styrene, alkyl-esters of the above carboxylate monomers (e.g. 1–20 alk(en)yl, preferably C5–16 alkyl) and mixtures thereof.

More preferably, the amphiphilic carboxy containing polymers are of the following type: styrene-acrylate copolymer, acrylate-alkylmethacrylate copolymers, ethoxylated methacrylate-acrylate copolymer, methacrylate- vinylacetate copolymer or itaconate-vinylacetate copolymers. Examples of such polymers are Narlex LD55, Narlex H100, Narlex H1200 and Narlex DC1 (Narlex is a registered Trade Mark of National Starch).

Additionally, the amphiphilic carboxy containing polymers may preferably be copolymers of ethoxylated maleate and dodecene-1. An example thereof is Dapral GE 202 (Trade Mark). Optionally, the amphiphilic carboxy containing polymer is partly ethoxylated, e.g. with a PEG 350 side chain.

Most preferably, the amphiphilic carboxy containing polymers are selected from copolymers of acrylic acid and styrene. Examples are Narlex H100 and Narlex H1200 (Trade Mark, National Starch).

The amphiphilic carboxy containing polymer is present at a level of about 0.01% to about 5% by weight of the composition, preferably about 0.025% to about 2%, more preferably about 0.05% to about 0.5%.

The ratio of carboxy containing hydrophilic monomers to uncharged monomers can vary in a broad range e.g. from 100:1 to 0.5:1, preferably from 50:1 to 1:1.

Polyvinylpyrrolidone (PVP)

Detergent compositions of the present invention include polyvinylpyrrolidone ("PVP"), an uncharged polymer generally having an average molecular weight of from 2,500 to 400,000, preferably from 5,000 to 200,000, more preferably from 5,000 to 50,000 and most preferably from 5,000 to 15,000. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). PVP K-15 is preferred due to its relatively small molecular weight. Other suitable polyvinylpyrrolidones which are commercially available from BASF Corporation include Sokalan HP 165 (Trade Mark) and Sokalan HP 12 (Trade Mark). Polyvinylpyrrolidones will be known to persons skilled in the detergent field; see for example EP-A-262,897 and EP-A-256,696.

The level of the uncharged polymer in the inventive softening laundry composition is about 0.05% to about 3%, preferably about 0.25% to about 1.5%, for instance 0.3% by weight of the composition.

Cationic Polymer

A cationic polymer is here defined to include polymers which, because of their molecular weight or monomer composition, are soluble or dispersible to at least the extent of 0.01% by weight in distilled water at 25° C. Water soluble cationic polymers include polymers in which one or more of the constituent monomers are selected from the list of copolymerizable cationic or amphoteric monomers. These monomer units contain a positive charge over at least a portion of the pH range 6–11. A partial listing of monomers can be found in the "International Cosmetic Ingredient Dictionary," 5th Edition, edited by J. A. Wenninger and G. N. McEwen, *The Cosmetic Toiletry, and Fragrance Association,* 1993. Another source of such monomers can be found in "Encyclopedia of Polymers and Thickeners for Cosmetics", by R. Y. Lochhead and W. R. Fron, *Cosmetics & Toiletries*, vol. 108, May 1993, pp 95–135.

The cationic polymers of this invention are effective at surprisingly low levels. As such, the ratio of cationic polymer to total surfactant in the composition should preferably be no greater than about 1:5, and more preferably less than about 1:10. The ratio of cationic polymer to anionic surfactant in the composition, on a mass basis, should be less than about 1:4, and ideally less than about 1:10, as well. The preferred compositions of this invention contain low levels, if any at all, of builder. Generally, these will comprise less than 10%, preferably less than 7% and most preferably less than 5% by weight of total phosphate and zeolite.

Specifically, monomers useful in this invention may be represented structurally as etiologically unsaturated compounds as in formula I.

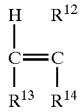

I wherein $R^{12}$ is hydrogen, hydroxyl, methoxy, or a $C_1$ to $C_{30}$ straight or branched alkyl radical; $R^{13}$ is hydrogen, or a $C_{1-30}$ straight or branched alkyl, a $C_{1-30}$ straight or branched alkyl substituted aryl, aryl substituted $C_{1-30}$ straight or branched alkyl radical, or a poly oxyalkene condensate of an aliphatic radical; and $R^{14}$ is a heteroatomic alkyl or aromatic radical containing either one or more quaternerized nitrogen atoms or one or more amine groups which possess a positive charge over a portion of the pH interval pH 6 to 11. Such amine groups can be further delineated as having a $pK_a$ of about 6 or greater.

Examples of cationic monomers of formula I include, but are not limited to, co-poly 2-vinyl pyridine and its co-poly 2-vinyl N-alkyl quaternary pyridinium salt derivatives; co-poly 4-vinyl pyridine and its co-poly 4-vinyl N-alkyl quaternary pyridinium salt derivatives; co-poly 4-vinylbenzyltrialkylammonium salts such as co-poly 4-vinylbenzyltrimethylammonium salt; co-poly 2-vinyl piperidine and co-poly 2-vinyl piperidinium salt; co-poly 4-vinylpiperidine and co-poly 4-vinyl piperidinium salt; co-poly 3-alkyl 1-vinyl imidazolium salts such as co-poly 3-methyl 1-vinyl imidazolium salt; acrylamido and methacrylamido derivatives such as co-poly dimethyl aminopropylmethacrylamide, co-poly acrylamidopropyl trimethylammonium salt and co-poly methacrylamidopropyl trimethylammonium salt; acrylate and methacrylate derivatives such as co-poly dimethyl aminoethyl (meth)acrylate, co-poly ethanaminium N,N,N trimethyl 2-[(1-oxo-2 propenyl)oxy]-salt, co-poly ethanaminium N,N,N trimethyl 2-[(2 methyl-1-oxo-2 propenyl)oxy]-salt, and co-poly ethanaminium N,N,N ethyl dimethyl 2-[(2 methyl-1-oxo-2 propenyl)oxy]-salt.

Also included among the cationic monomers suitable for this invention are co-poly vinyl amine and co-polyvinylammonium salt; co-poly diallylamine, co-poly methyldiallylamine, and co-poly diallydimethylammonium salt; and the ionene class of internal cationic monomers. This class includes co-poly ethylene imine, co-poly ethoxylated ethylene imine and co-poly quaternized ethoxylated ethylene imine; co-poly [(dimethylimino)trimethylene(dimethylimino)hexamethylene disalt], co-poly [(diethylimino)trimethylene(dimethylimino)trimethylene disalt]; co-poly [(dimethylimino)2-hydroxypropyl salt]; co-polyquarternium-2, co-polyquarternium- 17, and co-polyquarternium 18, as defined in the "International Cosmetic Ingredient Dictionary" edited by Wenninger and McEwen.

Additionally, useful polymers are the cationic co-poly amido-amine having the chemical structure of formula II.

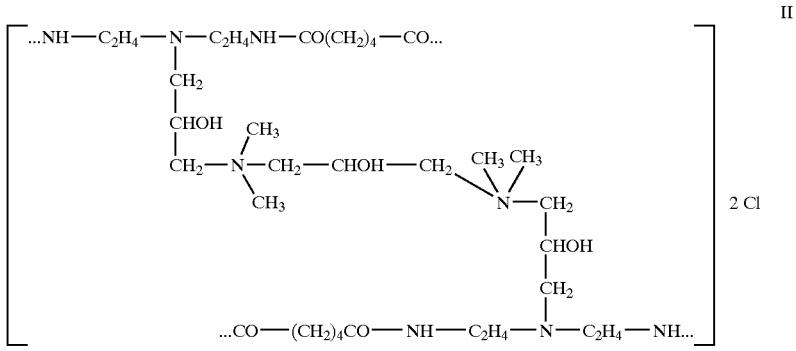

II and the quaternized polyimidazoline having the chemical structure of formula III

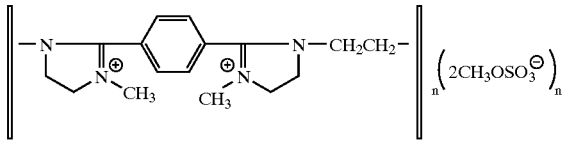

wherein the molecular weight of structures II and III can vary between about 10,000 and 10,000,000 Daltons and each is terminated with an appropriate terminating group such as, for example, a methyl group.

An additional, and highly preferred class of cationic monomers suitable for this invention are those arising from natural sources and include, but are not limited to, cocodimethylammonium hydroxypropyl oxyethyl cellulose, lauryidimethylammonium hydroxypropyl oxyethyl cellulose, stearyidimethylammonium hydroxypropyl oxyethyl cellulose, and stearyldimethylammonium hydroxyethyl cellulose; guar 2-hydroxy-3-(trimethylammonium)propyl ether salt; cellulose 2-hydroxyethyl 2-hydroxy 3-(trimethyl ammonio)propyl ether salt.

It is likewise envisioned that monomers containing cationic sulfonium salts such as co-poly 1-[3-methyl4-(vinylbenzyloxy)phenyl]tetrahydrothiophenium chloride would also be applicable to the present invention.

The counterion of the comprising cationic co-monomer is freely chosen from the halides: chloride, bromide, and iodide; or from hydroxide, phosphate, sulfate, hydrosulfate, ethyl sulfate, methyl sulfate, formate, and acetate.

Another class of cationic polymer useful for the present invention are the cationic silicones. These materials are characterized by repeating dialkylsiloxane interspersed or end terminated, or both, with cationic substituted siloxane units. Commercially available materials of this class are the Abil Quat polymers from Degussa Goldschmidt (Virginia).

The weight fraction of the cationic polymer which is composed of the above-described cationic monomer units can range from 1 to 100%, preferably from 10 to 100%, and most preferably from 15 to 80% of the entire polymer. The remaining monomer units comprising the cationic polymer are chosen from the class of anionic monomers and the class of nonionic monomers or solely from the class of nonionic monomers. In the former case, the polymer is an amphoteric polymer while in the 1o latter case it can be a cationic polymer, provided that no amphoteric co-monomers are present. Amphoteric polymers should also be considered within the scope of this disclosure, provided that the polymer unit possesses a net positive charge at one or more points over the wash pH range of pH 6 to 11. The anionic monomers comprise a class of monounsaturated compounds which possess a negative charge over the portion of the pH range from pH 6 to 11 in which the cationic monomers possess a positive charge. The nonionic monomers comprise a class of monounsaturated compounds which are uncharged over the pH range from pH 6 to 11 in which the cationic monomers possess a positive charge. It is expected that the wash pH at which this invention would be employed would either naturally fall within the above mentioned portion of the pH range 6–11 or, optionally, would be buffered in that range. A preferred class of both the anionic and the nonionic monomers are the vinyl (ethylenically unsaturated) substituted compounds corresponding to formula IV.

IV

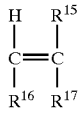

wherein $R^{15}$, $R^{16}$, and $R^{17}$ are independently hydrogen, a $C_1$ to $C_3$ alkyl, a carboxylate group or a carboxylate group substituted with a $C_1$ to $C_{30}$ linear or branched heteroatomic alkyl or aromatic radical, a heteroatomic radical or a poly oxyalkene condensate of an aliphatic radical.

The class of anionic monomers are represented by the compound described by formula IV in which at least one of the $R^{15}$, $R^{16}$, or $R^{17}$ comprises a carboxylate, substituted carboxylate, phosphonate, substituted phosphonate, sulfate, substituted sulfate, sulfonate, or substituted sulfonate group. Preferred monomers in this class include but are not limited to α-ethacrylic acid, α-cyano acrylic acid, β,β-dimethacrylic acid, methylenemalonic acid, vinylacetic acid, allylacetic acid, acrylic acid, ethylidineacetic acid, propylidineacetic acid, crotonic acid, methacrylic acid, maleic acid, fumaric acid, itaconic acid, sorbic acid, angelic acid, cinnamic acid, β-styryl acrylic acid (1-carboxy-4-phenyl butadiene-1,3), citraconic acid, glutaconic acid, aconitic acid, α-phenylacrylic acid, β-acryloxy propionic acid, citraconic acid, vinyl benzoic acid, N-vinyl succinamidic acid, and mesaconic acid. Also included in the list of preferred monomers are co-poly styrene sulfonic acid, 2-methacryloyloxymethane-1-sulfonic acid, 3-methacryloyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid and vinyl phosphoric acid. Most preferred monomers include acrylic acid, methacrylic acid and maleic acid. The polymers useful in this invention may contain the above monomers and the alkali metal, alkaline earth metal, and ammonium salts thereof.

The class of nonionic monomers are represented by the compounds of formula IV in which none of the $R^{15}$, $R^{16}$, or $R^{17}$ contain the above mentioned negative charge containing radicals. Preferred monomers in this class include, but are not limited to, vinyl alcohol; vinyl acetate; vinyl methyl ether; vinyl ethyl ether; acrylamide, methacrylamide and other modified acrylamides; vinyl propionate; alkyl acrylates (esters of acrylic or methacrylic acid); and hydroxyalkyl acrylate esters. A second class of nonionic monomers include co-poly ethylene oxide, co-poly propylene oxide, and co-poly oxymethylene. A third, and highly preferred, class of nonionic monomers includes naturally derived materials such as hydroxyethylcellulose and guar gum.

It is highly preferred, and often necessary in the case of certain compositions, to formulate the products of this invention with the proper ratio of cationic polymer to anionic surfactant. Too high a ratio can result in reduced softening, poor packing at the interface, unacceptable dissolution times and, in the case of liquid products, an excessively high viscosity which can render the product non-pourable, and thus unacceptable for consumer use. The use of lower ratios of cationic polymer to surfactant also reduces the overall level of polymer necessary for the formulation, which is also preferable for cost and environmental reasons, and gives the formulator greater flexibility in making a stable product. The preferred ratio of cationic polymer: total surfactant will be less than about 1:4, whereas the preferred ratio of cationic polymer: anionic surfactant will be less than about 1:5, and the preferred ratio of cationic polymer: nonionic surfactant will be less than about 1:5. More preferably, the ratios of cationic polymer: total surfactant, cationic polymer: anionic surfactant and cationic polymer: total surfactant will be less than about 1:10. In terms of absolute fraction, this often means that the concentration of cationic polymer will generally be less than about 5%, preferably less than about 2% and most preferably less than about 1% of the total product mass.

Without wishing to be bound by theory, it is believed that the species responsible for providing a conditioning benefit in these formulations is a polymer/surfactant complex. The compositions of this invention will preferably comprise at least about 2%, more preferably at least about 5%, and most preferably at least about 10% of one or more surfactants with a hydrophilic/lipophilic balance (HLB, defined in U.S. Pat. No. 6,461,387) of more than about 4.

Many of the aforementioned cationic polymers can be synthesized in, and are commercially available in, a number of different molecular weights. In order to achieve optimal cleaning and softening performance from the product, it is desirable that the water-soluble cationic or amphoteric polymer used in this invention be of an appropriate molecular weight. Without wishing to be bound by theory, it is believed that polymers that are too high in mass can entrap soils and prevent them from being removed. The use of cationic polymers with an average molecular weight of less than about 850,000 daltons, and especially those with an average molecular weight of less than 500,000 daltons can help to minimize this effect without significantly reducing the softening performance of properly formulated products. On the other hand, polymers with a molecular weight of about 10,000 daltons or less are believed to be too small to give an effective softening benefit.

Conditioning Benefits

The compositions of this invention are intended to confer conditioning benefits to garments, home textiles, carpets and other fibrous or fiber-derived articles. These formulations are not to be limited to conditioning benefits, however, and will often be multi-functional.

The primary conditioning benefit afforded by these products is softening. Softening includes, but is not limited to, an improvement in the handling of a garment treated with the compositions of this invention relative to that of an article laundered under identical conditions but without the use of this invention. Consumers will often describe an article that is softened as "silky" or "fluffy", and generally prefer the feel of treated garments to those that are unsoftened. It is desirable that the formulae of this invention, when used as instructed, yield a softness parameter of more than about 70. The preferred products give a softness parameter of more than about 80.

The conditioning benefits of these compositions are not limited to softening, however. They may, depending on the particular embodiment of the invention selected, also provide an antistatic benefit. In addition to softening, the cationic polymer/anionic surfactant compositions of this invention are further believed to lubricate the fibers of textile articles, which can reduce wear, pilling and color fading, and provide a shape-retention benefit. This lubricating layer may also, without wishing to be bound by theory, provide a substrate on the fabric for retaining fragrances and other benefit agents. Furthermore, the cationic polymers of this invention are also believed to inhibit the transfer, bleeding and loss of vagrant dyes from fabrics during the wash, further improving color brightness over time.

Form of the Invention

The present invention can take any of a number of forms, including a dilutable fabric conditioner, that may be an isotropic liquid, a surfactant-structured liquid or any other laundry detergent form known to those skilled in the art. A "dilutable fabric conditioning" composition is defined, for the purposes of this disclosure, as a product intended to be used by being diluted with water or a non-aqueous solvent by a ratio of more than 100:1, to produce a liquor suitable for treating textiles and conferring to them one or more conditioning benefits. As such, compositions intended to be used as combination detergent/softeners, along with fabric softeners sold for application in the final rinse of a wash cycle and fabric softeners sold for application at the beginning of a wash cycle are all considered within the scope of this invention. For all cases, however, these compositions are intended to be used by being diluted by a ratio of more than 100:1 with water or a non-aqueous solvent, to form a liquor suitable for treating fabrics.

Particularly preferred forms of this invention include combination detergent/softener products, especially as a liquid, and isotropic or surfactant-structured liquid products intended for application as a fabric softener during the wash cycle or the final rinse. For the purposes of this disclosure, the term "fabric softener" shall be understood to mean a consumer or industrial product added to the wash, rinse or dry cycle of a laundry process for the express or primary purpose of conferring one or more conditioning benefits.

The pH range of the composition is about 2 to about 12. As many cationic polymers can decompose at high pH, especially when they contain amine or phosphine moieties, it is desirable to keep the pH of the composition below the $pK_a$ of the amine or phosphine group that is used to quaternize the selected polymer, below which the propensity for this to occur is greatly decreased. This reaction can cause the product to lose effectiveness over time and create an undesirable product odor. As such, a reasonable margin of safety, of 1–2 units of pH below the $pK_a$ should ideally be used in order to drive the equilibrium of this reaction to strongly favor polymer stability. Although the preferred pH of the product will depend on the particular cationic polymer selected for formulation, typically these values should be below about 8.5 to about 10. Wash liquor pH, especially in the case of combination detergent/softener products, can often be less important, as the kinetics of polymer decomposition are often slow, and the time of one wash cycle is typically not sufficient to allow for this reaction to have a significant impact on the performance or odor of the product. A lower pH can also aid in the formulation of higher-viscosity products.

Conversely, as the product depends on the presence of soluble anionic surfactants to provide softening, its pH should preferably be above the $pK_a$ of the surfactant acids used to formulate it. In addition, aqueous detergent products, which are a highly preferred embodiment of this invention, are nearly impossible to formulate below the $pK_a$ of the surfactant acids used, as these molecules are rather insoluble in water when in acid form. Again, it is especially desirable to have the pH at least 1–2 units above the $pK_a$ of the surfactant acids, to ensure that the vast majority of anionic surfactant is present in salt form. Typically, this will suggest that the product pH should be above about 4, although in certain cases, such as when carboxylic acid salts, which often have a $pK_a$ around 4 or 5 are used, the pH of the product can need to be above about 7 or 8 to ensure effective softening.

The formulation may be buffered at the target pH of the composition.

Method of Use

The following details a method for conditioning textiles comprising the steps, in no particular order of:

a. providing a laundry detergent or fabric softener composition comprising at least one anionic surfactant and at least one cationic polymer, in a ratio and concentration to effectively soften and condition fabrics under predetermined laundering conditions; and an anti-redeposition system including PVP and an amphiphilic carboxy containing polymer;
b. contacting one or more articles with the composition at one or more points during a laundering process; and
c. allowing the articles to dry or mechanically tumble-drying them.

The softening parameter is greater than about 70, preferably greater than about 80, and the composition comprises more than about 5% by weight of one or more anionic surfactants having an HLB of greater than about 4.

Amounts of composition used will generally range between about 10 g and about 300 g total product per 3 kg of conditioned fibrous articles, depending on the particular embodiment chosen and other factors, such as consumer preferences, that influence product use behavior.

A consumer that would use the present invention could also be specifically instructed to contact the fabrics with the inventive composition with the purpose of simultaneously cleaning and softening the said fabrics. This approach would be recommended when the composition takes the form of a softening detergent to be dosed at the beginning of the wash cycle.

Insoluble Matter

It is preferred that the compositions of this disclosure be formulated with low levels, if any at all, of any matter that is substantially insoluble in the solvent intended to be used to dilute the product. For the purposes of this disclosure, "substantially insoluble" shall mean that the material in question can individually be dissolved at a level of less than 0.001% in the specified solvent. Examples of substantially insoluble matter in aqueous systems include, but are not limited to aluminosilicates, pigments, clays and the like. Without wishing to be bound by theory, it is believed that solvent-insoluble inorganic matter can be attracted and coordinated to the cationic polymers of this invention, which are believed to attach themselves to the articles being washed. When this occurs, it is thought that these particles can create a rough effect on the fabric surface, which in turn reduces the perception of softness.

In addition, as liquid compositions are a preferred embodiment of this invention, and insoluble matter is often difficult to formulate into a liquid, it is further desirable to minimize its level in the product. For this invention it is desirable to have the liquid compositions be substantially transparent for esthetic reasons. Thus, for the compositions of this invention it is desirable to have a percent transmittance of light of greater than about 50 using a 1 centimeter cuvette at a wavelength of 570 nanometers wherein the composition is measured in the absence of dyes. Alternatively, transparency of the composition may be measured as having an absorbence (A) at 570 nanometers of less than about 0.3 which is in turn equivalent to percent transmittance of greater than about 50 using the same cuvette as above. The relationship between absorbance and percent transmittance is:

$$\text{Percent Transmittance}=100(1/\text{inverse log } A)$$

Preferably, insoluble and substantially insoluble matter will be limited to less than 10% of the composition, more preferably to about 5%. Most preferably, especially in the case of liquid conditioning compositions, the composition will be essentially free, or have less than about 5%, of substantially insoluble matter or precipitation.

Optional Ingredients

In addition to the above-mentioned essential elements, the formulator may include one or more optional ingredients, which are often very helpful in rendering the formulation more acceptable for consumer use.

Examples of optional components include, but are not limited to: nonionic surfactants, amphoteric and zwitterionic surfactants, cationic surfactants, hydrotropes, fluorescent whitening agents, photobleaches, fiber lubricants, reducing agents, enzymes, enzyme stabilizing agents, powder finishing agents, defoamers, builders, bleaches, bleach catalysts, soil release agents, dye transfer inhibitors, buffers, colorants, fragrances, pro-fragrances, rheology modifiers, anti-ashing polymers, preservatives, insect repellents, soil repellents, water-resistance agents, suspending agents, aesthetic agents, structuring agents, sanitizers, solvents, fabric finishing agents, dye fixatives, wrinkle-reducing agents, fabric conditioning agents and deodorizers.

Preservatives

Optionally, a soluble preservative may be added to this invention. The use of a preservative is especially preferred when the composition of this invention is a liquid, as these products tend to be especially susceptible to microbial growth.

The use of a broad-spectrum preservative, which controls the growth of bacteria and fungi is preferred. Limited-spectrum preservatives, which are only effective on a single group of microorganisms may also be used, either in combination with a broad-spectrum material or in a "package" of limited-spectrum preservatives with additive activities. Depending on the circumstances of manufacturing and consumer use, it may also be desirable to use more than one broad-spectrum preservative to minimize the effects of any potential contamination.

The use of both biocidal materials, i.e. substances that kill or destroy bacteria and fungi, and biostatic preservatives, i.e. substances that regulate or retard the growth of microorganisms, may be indicated for this invention.

In order to minimize environmental waste and allow for the maximum window of formulation stability, it is preferred that preservatives that are effective at low levels be used. Typically, they will be used only at an effective amount. For the purposes of this disclosure, the term "effective amount" means a level sufficient to control microbial growth in the product for a specified period of time, i.e., two weeks, such that the stability and physical properties of it are not negatively affected. For most preservatives, an effective amount will be between about 0.00001% and about 0.5% of the total formula, based on weight. Obviously, however, the effective level will vary based on the material used, and one skilled in the art should be able to select an appropriate preservative and use level.

Preferred preservatives for the compositions of this invention include organic sulfur compounds, halogenated materials, cyclic organic nitrogen compounds, low molecular weight aldehydes, quaternary ammonium materials, dehydroacetic acid, phenyl and phenoxy compounds and mixtures thereof.

Examples of preferred preservatives for use in the compositions of the present invention include: a mixture of about 77% 5-chloro-2-methyl-4-isothiazolin-3-one and about 23% 2-methyl-4-isothiazolin-3-one, which is sold commercially as a 1.5% aqueous solution by Rohm & Haas (Philadelphia, Pa.) under the trade name Kathon; 1,2-benzisothiazolin-3-one, which is sold commercially by Avecia (Wilmington, Del.) as, for example, a 20% solution in dipropylene glycol sold under the trade name Proxel GXL; and a 95:5 mixture of 1,3 bis (hydroxymethyl)-5,5-dimethyl-2,4 imidazolidinedione and 3-butyl-2-iodopropynyl carbamate, which can be obtained, for example, as Glydant Plus from Lonza (Fair Lawn, N.J.).

Nonionic Surfactants

Nonionic surfactants are useful in the context of this invention to both improve the cleaning properties of the compositions, when used as a detergent, and to contribute to product stability. For the purposes of this disclosure, "nonionic surfactant" shall be defined as amphiphilic molecules with a molecular weight of less than about 10,000, unless otherwise noted, which are substantially free of any functional groups that exhibit a net charge at the normal wash pH of 6–11. Any type of nonionic surfactant may be used, although preferred materials are further discussed below.

Fatty Alcohol Ethoxylates:

$$R^{18}O(EO)_n$$

Wherein $R^{18}$ represents an alkyl chain of between 4 and 30 carbon atoms, (EO) represents one unit of ethylene oxide monomer and n has an average value between 0.5 and 20. R may be linear or branched. Such chemicals are generally produced by oligomerizing fatty alcohols with ethylene oxide in the presence of an effective amount catalyst, and are sold in the market as, for example, Neodols from Shell (Houston, Tex.) and Alfonics from Sasol (Austin, Tex.). The fatty alcohol starting materials, which are marketed under trademarks such as Alfol, Lial and Isofol from Sasol (Austin, Tex.) and Neodol, from Shell, may be manufactured by any of a number of processes known to those skilled in the art, and can be derived from natural or synthetic sources or a combination thereof. Commercial alcohol ethoxylates are typically mixtures, comprising varying chain lengths of $R^{18}$ and levels of ethoxylation. Often, especially at low levels of ethoxylation, a substantial amount of unethoxylated fatty alcohol remains in the final product, as well.

Because of their excellent cleaning, environmental and stability profiles, fatty alcohol ethoxylates wherein $R^{18}$ represents an alkyl chain from 10–18 carbons and n is an average number between 5 and 12 are highly preferred.

Alkylphenol Ethoxylates:

$$R^{19}ArO(EO)_n$$

Where $R^{19}$ represents a linear or branched alkyl chain ranging from 4 to 30 carbons, Ar is a phenyl ($C_6H_4$) ring and $(EO)_n$ is an oligomer chain comprised of an average of n moles of ethylene oxide. Preferably, $R^{19}$ is comprised of between 8 and 12 carbons, and n is between 4 and 12. Such materials are somewhat interchangeable with alcohol ethoxylates, and serve much the same function. A commercial example of an alkylphenol ethoxylate suitable for use in this invention is Triton X-100, available from Dow Chemical (Midland, Mich.)

Ethylene Oxide/Propylene Oxide Block Polymers:

$$(EO)_x(PO)_y(EO)_x \text{ or } (PO)_x(EO)_y(PO)_x$$

wherein EO represents an ethylene oxide unit, PO represents a propylene oxide unit, and x and y are numbers detailing the average number of moles ethylene oxide and propylene oxide in each mole of product. Such materials tend to have higher molecular weights than most nonionic surfactants, and as such can range between 1,000 and 30,000 daltons. BASF (Mount Olive, N.J.) manufactures a suitable set of derivatives and markets them under the Pluronic and Pluronic-R trademarks.

Other nonionic surfactants should also be considered within the scope of this invention. These include condensates of alkanolamines with fatty acids, such as cocamide DEA, polyol-fatty acid esters, such as the Span series available from Uniqema (Wilmington, Del.), ethoxylated polyol-fatty acid esters, such as the Tween series available from Uniqema (Wilmington, Del.), Alkylpolyglucosides, such as the APG line available from Cognis (Gulph Mills, Pa.) and n-alkylpyrrolidones, such as the Surfadone series of products marketed by ISP (Wayne, N.J). Furthermore, nonionic surfactants not specifically mentioned above, but within the definition, may also be used.

Fluorescent Whitening Agents

Many fabrics, and cottons in particular, tend to lose their whiteness and adopt a yellowish tone after repeated washing. As such, it is customary and preferred to add a small amount of fluorescent whitening agent, which absorbs light in the ultraviolet region of the spectrum and re-emits it in the visible blue range, to the compositions of this invention, especially if they are combination detergent/fabric conditioner preparations.

Suitable fluorescent whitening agents include derivatives of diaminostilbenedisulfonic acid and their alkali metal salts. Particularly, the salts of 4,4'-bis(2-anilino4-morpholino-1,3,5-triazinyl-6-amino)stilbene-2,2'-disulfonic acid, and related compounds where the morpholino group is replaced by another nitrogen-comprising moiety, are preferred. Also preferred are brighteners of the 4,4'-bis(2-sulfostyryl) biphenyl type, which may optionally be blended with other fluorescent whitening agents at the option of the formulator. Typical fluorescent whitening agent levels in the preparations of this invention range between 0.001% and 1%, although a level between 0.1% and 0.3%, by mass, is normally used. Commercial supplies of acceptable fluorescent whitening agents can be sourced from, for example, Ciba Specialty Chemicals (High Point, N.C.) and Bayer (Pittsburgh, Pa.).

Builders

Builders are often added to fabric cleaning compositions to complex and remove alkaline earth metal ions, which can interfere with the cleaning performance of a detergent by combining with anionic surfactants and removing them from the wash liquor. The preferred compositions of this invention, especially when used as a combination detergent/softener, contain builders.

Soluble builders, such as alkali metal carbonates and alkali metal citrates, are particularly preferred, especially for the liquid embodiment of this invention. Other builders, as further detailed below, may also be used, however. Often a mixture of builders, chosen from those described below and others known to those skilled in the art, will be used.

Alkali and Alkaline Earth Metal Carbonates:

Alkali and alkaline earth metal carbonates, such as those detailed in German patent application 2,321,001, published Nov. 15, 1973, are suitable for use as builders in the compositions of this invention. They may be supplied and used either in anhydrous form, or including bound water. Particularly useful is sodium carbonate, or soda ash, which both is readily available on the commercial market and has an excellent environmental profile.

The sodium carbonate used in this invention may either be natural or synthetic, and, depending on the needs of the formula, may be used in either dense or light form. Natural soda ash is generally mined as trona and further refined to a degree specified by the needs of the product it is used in. Synthetic ash, on the other hand, is usually produced via the Solvay process or as a coproduct of other manufacturing operations, such as the synthesis of caprolactam. It is sometimes further useful to include a small amount of calcium carbonate in the builder formulation, to seed crystal formation and increase building efficacy.

Organic Builders:

Organic detergent builders can also be used as nonphosphate builders in the present invention. Examples of organic builders include alkali metal citrates, succinates, malonates, fatty acid sulfonates, fatty acid carboxylates, nitrilotriacetates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, acrylate/maleate/vinyl alcohol terpolymers, aminopolycarboxylates and polyacetal carboxylates, and polyaspartates and mixtures thereof. Such carboxylates are described in U.S. Pat. Nos. 4,144,226, 4,146,495 and 4,686,062. Alkali metal citrates, nitrilotriacetates, oxydisuccinates, acrylate/maleate copolymers and acrylate/maleate/vinyl alcohol terpolymers are especially preferred nonphosphate builders.

Phosphates:

The compositions of the present invention which utilize a water-soluble phosphate builder typically contain this builder at a level of from 1 to 90% by weight of the composition. Specific examples of water-soluble phosphate builders are the alkali metal tripolyphosphates, sodium, potassium and ammonium pyrophosphate, sodium and potassium orthophosphate, sodium polymeta/phosphate in which the degree of polymerization ranges from about 6 to 21, and salts of phytic acid. Sodium or potassium tripolyphosphate is most preferred.

Phosphates are, however, often difficult to formulate, especially into liquid products, and have been identified as potential agents that may contribute to the eutrophication of lakes and other waterways. As such, the preferred compositions of this invention comprise phosphates at a level of less than about 10% by weight, more preferably less than about 5% by weight. The most preferred compositions of this invention are formulated to be substantially free of phosphate builders.

Zeolites:

Zeolites may also be used as builders in the present invention. A number of zeolites suitable for incorporation into the products of this disclosure are available to the formulator, including the common zeolite 4A. In addition, zeolites of the MAP variety, such as those taught in European Patent Application EP 384,070B, which are sold commercially by, for example, Ineos Silicas (UK), as Doucil A24, are also acceptable for incorporation. MAP is defined as an alkali metal aluminosilicate of zeolite P type having a silicon to aluminium ratio not exceeding 1.33, preferably within the range of from 0.90 to 1.33, more preferably within the range of from 0.90 to 1.20.

Especially preferred is zeolite MAP having a silicon to aluminium ratio not exceeding 1.07, more preferably about 1.00. The particle size of the zeolite is not critical. Zeolite A or zeolite MAP of any suitable particle size may be used. In any event, as zeolites are insoluble matter, it is advantageous to minimize their level in the compositions of this invention. As such, the preferred formulations contain less than about 10% of zeolite builder, while especially preferred compositions comprise less than about 5% zeolite.

Enzyme Stabilizers

When enzymes, and especially proteases are used in liquid detergent formulations, it is often necessary to include a suitable quantity of enzyme stabilizer to temporarily deactivate it until it is used in the wash. Examples of suitable enzyme stabilizers are well-known to those skilled in the art, and include, for example, borates and polyols such as propylene glycol. Borates are especially suitable for use as enzyme stablizers because in addition to this benefit, they can further buffer the pH of the detergent product over a wide range, thus providing excellent flexibility.

If a borate-based enzyme stabilization system is chosen, along with one or more cationic polymers that are at least partially comprised of carbohydrate moeities, stability problems can result if suitable co-stablizers are not used. It is believed that this is the result of borates' natural affinity for hydroxyl groups, which can create an insoluble borate-polymer complex that precipitates from solution either over time or at cold temperatures. Incorporating into the formulation a co-stabilizer, which is normally a diol or polyol, sugar or other molecule with a large number of hydroxyl groups, can ordinarily prevent this. Especially preferred for use as a co-stabilizer is sorbitol, used at a level that is at least about 0.8 times the level of borate in the system, more preferably 1.0 times the level of borate in the system and most preferably more than 1.43 times the level of borate in the system, is sorbitol, which is effective, inexpensive, biodegradable and readily available on the market. Similar materials including sugars such as glucose and sucrose, and other poyols such as propylene glycol, glycerol, mannitol, maltitol and xylitol, should also be considered within the scope of this invention.

Fiber Lubricants

In order to enhance the conditioning, softening, wrinkle-reduction and protective effects of the compositions of this invention, it is often desirable to include one or more fiber lubricants in the formulation. Such ingredients are well known to those skilled in the art, and are intended to reduce the coefficient of friction between the fibers and yarns in articles being treated, both during and after the wash process. This effect can in turn improve the consumer's perception of softness, minimize the formation of wrinkles and prevent damage to textiles during the wash. For the purposes of this disclosure, "fiber lubricants" shall be considered non-cationic materials intended to lubricate fibers for the purpose of reducing the friction between fibers or yarns in an article comprising textiles which provide one or more wrinkle-reduction, fabric conditioning or protective benefit.

Examples of suitable fiber lubricants include oily sugar derivatives, functionalized plant and animal-derived oils, silicones, mineral oils, natural and synthetic waxes and the like. Such ingredients often have low HLB values, less than about 10, although exceeding this level is not outside of the scope of this invention.

Oily sugar derivatives suitable for use in this invention are taught in WO 98/16538, which are especially preferred as fiber lubricants, due to their ready availability and favorable environmental profile. When used in the compositions of this invention, such materials are typically present at a level between about 1% and about 10% of the finished composition. Another class of acceptable ingredients includes hydrophilically-modified plant and animal oils and synthetic triglycerides. Suitable and preferred hydrophilically modified plant, animal, and synthetic triglyceride oils and waxes have been identified as effective fiber lubricants. Such suitable plant derived triglyceride materials include hydrophilically modified triglyceride oils, e.g. sulfated, sulfonated, carboxylated, alkoxylated, esterified, saccharide modified, and amide derivatized oils, tall oils and derivatives thereof, and the like. Suitable animal derived triglyceride materials include hydrophilically lo modified fish oil, tallow, lard, and lanolin wax, and the like. An especially preferred functionalized oil is sulfated castor oil, which is sold commercially as, for example, Freedom SCO-75, available from Noveon (Cleveland, Ohio).

Various levels of derivatization may be used provided that the derivatization is level is sufficient for the oil or wax derivatives to become soluble or dispersible in the solvent it is used in so as to exert a fiber lubrication effect during laundering of fabrics with a detergent containing the oil or wax derivative.

If this invention includes a functionalized oil of synthetic origin, preferably this oil is a silicone oil. More preferably, it is either a silicone poly ether or amino-functional silicone. If this invention incorporates a silicone polyether, it is preferably of one of the two general structures shown below:

Structure A

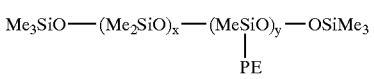

Structure B

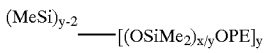

Where PE represents:

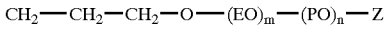

where Me represents methyl; EO represents ethylene oxide; PO represents 1,2 propylene oxide; Z represents either a hydrogen or a lower alkyl radical; x, y, m, n are constants and can be varied to alter the properties of the functionalized silicone.

A molecule of either structure can be used for the purposes of this invention. Preferably, this molecule contains more than 30% silicone, more than 20% ethylene oxide and less than 30% propylene oxide by weight, and has a molecular weight of more than 5,000. An example of a suitable, commercially available such material is L-7622, available from Crompton Corporation, (Greenwich, Conn.)

When the use of a fiber lubricant is elected, it will generally be present as between 0.1% and 15% of the total composition weight.

Bleach Catalyst

An effective amount of a bleach catalyst can also be present in the invention. A number of organic catalysts are available such as the sulfonimines as described in U.S. Pat. Nos. 5,041,232; 5,047,163 and 5,463,115.

Transition metal bleach catalysts are also useful, especially those based on manganese, iron, cobalt, titanium, molybdenum, nickel, chromium, copper, ruthenium, tungsten and mixtures thereof. These include simple water-soluble salts such as those of iron, manganese and cobalt as well as catalysts containing complex ligands.

Suitable examples of manganese catalysts containing organic ligands are described in U.S. Pat. No. 4,728,455, U.S. Pat. No. 5,114,606, U.S. Pat No. 5,153,161, U.S. Pat. No. 5,194,416, U.S. Pat. No. 5,227,084, U.S. Pat. No. 5,244,594, U.S. Pat. No. 5,246,612, U.S. Pat. No. 5,246,621, U.S. Pat. No. 5,256,779, U.S. Pat. No. 5,274,147, U.S. Pat. No. 5,280,117 and European Pat. App. Pub. Nos. 544,440, 544,490, 549,271 and 549,272. Preferred examples of these catalysts include $Mn^{IV}{}_2(u\text{-}O)_2$(1,4,7-trimethyl-1,4,7-triazacyclononane)$_2(PF_6)_2$, $Mn^{III}{}_2(u\text{-}O)_1(u\text{-}OAc)_2$(1,4,7-trimethyl-1,4,7-triazacyclononane)$_2(ClO_4)_2$, $Mn^{IV}{}_4(u\text{-}O)_6$(1,4,7-triazacyclononane)$_4$ $(ClO_4)_4$, $Mn^{III}Mn^{IV}{}_4(u\text{-}O)_1(u\text{-}OAc)_2$(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 and U.S. Pat. No. 5,114,611. Other examples of complexes of transition metals include Mn gluconate, $Mn(CF_3SO_3)_2$, and binuclear Mn complexed with tetra-N-dentate and bi-N-dentate ligands, including $[bipy_2Mn^{III}(u\text{-}O)_2Mn^{IV}bipy_2]$-$(ClO_4)_3$.

Iron and manganese salts of aminocarboxylic acids in general are useful herein including iron and manganese aminocarboxylate salts disclosed for bleaching in the photographic color processing arts. A particularly useful transition metal salt is derived from ethylenediaminedisuccinate and any complex of this ligand with iron or manganese.

Another type of bleach catalyst, as disclosed in U.S. Pat. No. 5,114,606, is a water soluble complex of manganese (II), (Ill), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose and mixtures thereof. Especially preferred is sorbitol.

Other bleach catalysts are described, for example, in European Pat. App. Pub. Nos. 408,131 (cobalt complexes), 384,503 and 306,089 (metallo-porphyrins), U.S. Pat. No. 4,728,455 (manganese/multidenate ligand), U.S. Pat. No. 4,711,748 (absorbed manganese on aluminosilicate), U.S. Pat. No. 4,601,845 (aluminosilicate support with manganese, zinc or magnesium salt), U.S. Pat. No. 4,626,373 (manganese/ligand), U.S. Pat. No. 4,119,557 (ferric complex), U.S. Pat. No. 4,430,243 (Chelants with manganese cations and non-catalytic metal cations), and U.S. Pat. No. 4,728,455 (manganese gluconates).

Useful catalysts based on cobalt are described in WO 96/23859, WO 96/23860 and WO 96/23861 and U.S. Pat. 5,559,261. WO 96/23860 describe cobalt catalysts of the type $[Co_nL_mX_p]^ZY_z$, where L is an organic ligand molecule containing more than one heteroatom selected from N, P, O and S; X is a coordinating species; n is preferably 1 or 2; m is preferably 1 to 5; p is preferably 0 to 4 and Y is a counterion. One example of such a catalyst is N,N'-Bis(salicylidene)ethylenediaminecobalt(II). Other cobalt catalysts described in these applications are based on Co(III) complexes with ammonia and mono-, bi-, tri- and tetradentate ligands such as $[Co(NH_3)_5OAc]^{2+}$ with $Cl^-$, $OAc^-$, $PF_6^-$, $SO_4^=$, and $BF_4^-$ anions.

Certain transition-metal containing bleach catalysts can be prepared in the situ by the reaction of a transition-metal salt with a suitable chelating agent, for example, a mixture of manganese sulfate and ethylenediaminedisuccinate. Highly colored transition metal-containing bleach catalysts may be co-processed with zeolites to reduce the color impact.

When present, the bleach catalyst is typically incorporated at a level of about 0.0001 to about 10% by wt., preferably about 0.001 to about 5% by weight.

Hydrotropes

In many liquid and powdered detergent compositions, it is customary to add a hydrotrope to modify product viscosity and prevent phase separation in liquids, and ease dissolution in powders.

Two types of hydrotropes are typically used in detergent formulations and are applicable to this invention. The first of these are short-chain functionalized amphiphiles. Examples of short-chain amphiphiles include the alkali metal salts of xylenesulfonic acid, cumenesulfonic acid and octyl sulfonic acid, and the like. In addition, organic solvents and monohydric and polyhydric alcohols with a molecular weight of less than about 500, such as, for example, ethanol, isopropanol, acetone, propylene glycol and glycerol, may also be used as hydrotropes.

The following examples will more fully illustrate the embodiments of this invention. All parts, percentages and proportions referred to herein and in the appended claims are by weight unless otherwise illustrated. Physical test methods are described below.

TEST METHOD AND EXAMPLES

Cleaning, Redeposition, and Graving

Cleaning, redeposition, and graying examples were generated under the following conditions:—17 gallons of water per wash; 35 deg. Celcius wash—cold water rinse; 12 minutes per wash—tumble dried after each wash; 6 pounds of total fabric per wash (comprises an 11"×11" cloth for visualizing graying and the balance white cotton sheets—the 11"×11" cloth is a terry towel named TIC-439 and is available from Textile Innovators of Charlotte, N.C.); any chemicals that may have been on the fabrics were removed by washing 3 times with liquid all™ detergent prior to use; each wash contained 5 g of Georgia clay that is sewn into a 2"×2" cotton fabric pouch (~2"×2").

To measure the extent of graying, spectrophotometer readings were taken on terry towels after 3 repeat wash/dry cycles with a given detergent using a Hunter Spectrophotometer. The L,a,b scale was used to measure cleaning. Graying results were reported as delta E values (ΔE) using the following calculation:

$$\Delta E=\sqrt{(L_{washed}-L_{clean})^2+(a_{washed}-a_{clean})^2+(b_{washed}-b_{clean})^2}$$

where,

L measures black to white differences, a measures green to red differences and, b measures blue to yellow differences.

The larger the (delta E) ΔE value, the more gray is the terry towel. Greater than about a 1–2 unit difference can be seen visually.

The pH for formulations 1–6 can range between 7.5 and 9.5 with 8.5 being most preferred. The pH for formulation 7 can range between 10.5 and 12.5 with 11.5 being most preferred.

Softening

Fabric was washed with a variety of product, the formulations for which are set forth hereinbelow. The washed fabric was then tested by consumer panels for perceived softening. For each of the washes, product was added to a top loading Whirlpool washing machine that contained 17 gallons of water and 6 pounds of fabric. There were several 86% cotton/14% polyester hand towels in each machine along with 100% cotton sheets to bring the total weight of the fabric to 6 pounds. The temperature of the water for the washes was 32 deg. C. and the fabrics were washed for 12 minutes. After the rinse cycle, the fabrics were tumble dried. Two washes were done with each product. Each formula tested is benchmarked against two controls—one using a model detergent (dosed at 130g at the beginning of the wash), and one using a model detergent plus a model liquid fabric softener. For the latter control, 100 g of the softening formula is added at the beginning of the rinse cycle. The formulae for the model detergents are shown in the tables below:

TABLE 1

Model Liquid Detergent

| Ingredient | Percent in Formula (based on 100% active) |
|---|---|
| Sodium linear alkylbenzenesulfonate | 10.2 |
| Alcohol ethoxylate | 9.5 |
| Sodium silicate | 3.3 |

TABLE 1-continued

Model Liquid Detergent

| Ingredient | Percent in Formula (based on 100% active) |
|---|---|
| Hydrotrope | 0.5 |
| Sodium stearate | 0.4 |
| Fluorescent whitening agent | 0.1 |
| Water | to 100 |

The formula for the model liquid fabric softener is:

TABLE 2

Model Liquid Fabric Softener

| Ingredient | Percent in Formula (based on 100% active) |
|---|---|
| Dihydrogenated tallow dimethyl ammonium chloride | 3.5 |
| lactic acid | 0.015 |
| Calcium chloride | 0.015 |
| Water | to 100 |

Five panelists scored the softness of the hand towels on a 0–10 scale with 0 being "not soft at all" and 10 being "extremely soft". Duplicate panels were run based on the duplicate washes and the scores averaged over the two runs. A Softening Parameter (SP) was then calculated using the following formula:

$$SP=[(S_t-S_d)/(S_c-S_d)]\times 100$$

Where, $S_t$ is the softening score for the formula being tested $S_d$ is the softening score for model detergent, and $S_c$ is the softening score for the model detergent+model liquid fabric softener.

Example 1

This example demonstrates that inclusion of a cationic polymer in the detergent is the cause of redeposition of the particulate soil. The following two formulas were tested for graying—formulation 1 did not contain cationic polymer, while formulation 2 did contain cationic polymer.

TABLE 3

Formulation 1

| Ingredient | Percent in Formula (based on 100% active) |
|---|---|
| linear alkylbenzene sulfonic acid | 8.0 |
| coconut oil fatty acid | 8.0 |
| alcohol ethoxylate | 10.0 |
| alcohol ethoxy sulfate | 3.0 |
| sodium hydroxide | 2.5 |
| Triethanolamine | 1.0 |
| Sorbitol | 5.0 |
| propylene glycol | 4.0 |
| Protease | 0.5 |
| sodium borate | 3.0 |
| fluorescent whitening agent | 0.15 |
| Water | to 100 |

TABLE 4

Formulation 2

| Ingredient | Percent in Formula (based on 100% active) |
|---|---|
| linear alkylbenznene sulfonic acid | 8.0 |
| coconut oil fatty acid | 8.0 |
| alcohol ethoxylate | 10.0 |
| alcohol ethoxy sulfate | 3.0 |
| sodium hydroxide | 2.5 |
| Triethanolamine | 1.0 |
| Sorbitol | 5.0 |
| propylene glycol | 4.0 |
| Protease | 0.5 |
| sodium Borate | 3.0 |
| fluorescent whitening agent | 0.15 |
| Polymer LR 400[1] | 0.30 |
| Water | to 100 |

[1]A cationic cellulose polymer available from the Amerchol division of Dow Chemical, Edison N.J.

ΔE for formulation 1 (no cationic polymer) was less than 2, while for formulation 2 (containing cationic polymer), ΔE was 12.

Example 2

Examples 2 and 3 illustrate how the antiredeposition performance of fabric softening compositions comprising cationic polymers can be improved without negatively impacting their conditioning properties. The following formulas were tested for graying:

TABLE 5

Formulations 3–5

| Formulation Number | Description |
|---|---|
| 3 | Formulation 2 plus 0.42% PVP K-15[1] |
| 4 | Formulation 2 plus 0.42% Alcosperse 725[2] |
| 5 | Formulation 2 plus 0.3% PVP K-15 and 0.12% Alcosperse 725 |

[1]Polyvinylpyrrolidone available from International Specialty Chemicals, Wayne, NJ.
[2]A polyacrylate available from the Alco division of National Starch and Chemical Co. which is a division of Imperial Chemical Industries, Chattanooga, TN.

Graying results are shown in the Table below:

TABLE 6

Graying Results

| Formulation | Delta E |
|---|---|
| 3 | 12 |
| 4 | 12 |
| 5 | 7 |

As can be seen from the tables above, only the combination of PVP and Alcosperse significantly reduces the amount of redeposition of clay to the terry towels.

Example 3

This example demonstrates that certain anionic polymers, but not the polymers identified in this application, are prone to deactivating the fabric softening ability of cationic polymers when formulated into liquid detergent products. Formulations 6–9 were prepared and tested for softening, and compared with Formulation 2 as shown in the table below.

TABLE 7

Formulations 6–9

| Formulation Number | Description | Softening Parameter |
|---|---|---|
| 2 | | 101 |
| 6 | Formulation 2 plus 0.3% Flexan 130[1] | 22 |
| 7 | Formulation 2 plus 0.3% low molecular-weight polystyrene sulfonate[2] | 10 |
| 8 | Formulation 2 plus 0.3% Kelzan HP[3] | 65 |
| 9 | Formulation 2 plus 0.3% Alcosperse 725[4] | 104 |

[1]A high molecular-weight polystyrene sulfonate available from the National Starch and Chemical Company, which is a division of Imperial Chemical Industries, Bridgewater, NJ.
[2]Available from the National Starch and Chemical Company, which is a division of Imperial Chemical Industries, Bridgeewater, NJ.
[3]Xanthan gum, available from CP Kelco, San Diego, CA.
[4]A polyacrylate available from the Alco division of National Starch and Chemical Co. which is a division of Imperial Chemical Industries, Chattanooga, TN.

These results demonstrate that ordinarily, cationic polymers will complex with anionic polymers, leading to a significant reduction in their ability to soften. Surprisingly, however, Alcosperse 725, and similar acrylate polymers are able to both give an antiredeposition benefit and retain the softening benefit of the original formulaiton.

The data in Examples 2 and 3 show that using a cationic polymer and anionic surfactant, in combination with PVP and an amphiphilic carboxy substituted polymer, can improve anti-redeposition performance without negatively impacting softening.

Example 4

The inventive polyvinylpyrrolidone/polyacrylate combination can also be successfully used in the following model formulas:

TABLE 8

Formulation 8

| Ingredient | Percent in Formula (based on 100% active) |
|---|---|
| Alcohol ethoxylate | 4–25 |
| Total anionic surfactant[1] | 5–50 |
| Propylene glycol | 0–10 |
| Sodium hydroxide | 0.1–5 |
| Triethanolamine | 0–5 |
| Sodium citrate | 0–10 |
| Sodium borate | 0–10 |
| Softening cationic polymer[2] | 0.1–5 |
| Fluorescent whitening agent | 0–1 |
| Antiredeposition polymer | 0–2 |
| Protease enzyme | 0–1 |
| Lipase enzyme | 0–1 |
| Cellulase enzyme | 0–1 |
| Perfume | 0–2 |
| Preservative | 0–1 |
| Soil release polymer | 0–2 |
| Water | to 100 |

[1]e.g. linear alkyl benzene sulfonic acid; neutralized fatty acids (including oleic; coconut; stearic); secondary alkane sulfonate; alcohol ethoxy sulfate.
[2]e.g. cationic cellulose; cationic guar.

TABLE 9

| Formulation 9 | |
|---|---|
| Ingredient | Percent in Formula (based on 100% active) |
| Ethoxylated nonionics | 4.0–25.0 |
| Total anionic surfactant[1] | 5–50 |
| Sodium hydroxide | 0–10.0 |
| Softening cationic polymer[2] | 0.1–5.0 |
| Sodium xylene sulfonate | 0–8.0 |
| Sodium silicate | 1.0–12.0 |
| Fluorescent whitening agent | 0–0.4 |
| Fragrance | 0–1.0 |
| Water | To 100 |

[1]e.g. linear alkyl benzene sulfonic acid; neutralized fatty acids (including oleic; coconut; stearic); secondary alkane sulfonate; alcohol ethoxy sulfate.
[2]e.g. cationic cellulose; cationic guar.

While the present invention has been described herein with some specificity, and with reference to certain preferred embodiments thereof, those of ordinary skill in the art will recognize numerous variations, modifications and substitutions of that which has been described which can be made, and which are within the scope and spirit of the invention. It is intended that all of these modifications and variations be within the scope of the present invention as described and claimed herein, and that the inventions be limited only by the scope of the claims which follow, and that such claims be interpreted as broadly as is reasonable. Throughout this application, various publications have been cited. The entireties of each of these publications are hereby incorporated by reference herein.

What is claimed is:

1. A conditioning liquid laundry composition with improved particulate soil cleaning comprising:

a. at least 5% of at least one anionic surfactant;

b. about 0.01% to 5% of at least one amphiphilic carboxy containing polymer;

c. about 0.05% to about 3% of polyvinylpyrrolidone polymer; and d. at least one cationic conditioning polymer, Wherein said composition comprises less than 10% phosphate.

2. The composition according to claim 1, wherein the Softening Parameter is greater than 70.

3. The composition according to claim 1, wherein said amphiphilic carboxy containing polymer is an anionic polyacrylate polymer.

4. The composition according to claim 1, wherein said cationic polymer is selected from the group consisting of dimethyl diallyl ammonium chloride/acrylamide copolymer, dimethyl diallyl ammonium chloride/acrylic acid/acrylamide terpolymer, vinylpyrrolidone/methyl vinyl imidazolium chloride copolymer, polydimethyl diallyl ammonium chloride, starch hydroxypropyl trimmonium chloride, polymethacryl amidopropyl trimethyl ammonium chloride, acrylamidopropyl trimmonium chloride/acrylamide copolymer, guar hydroxypropyl trimonium chloride, hydroxyethyl cellulose derivatized with trimethyl ammonium substituted epoxide, and mixtures thereof.

5. The composition according to claim 1, wherein said cationic polymer has a molecular weight of less than 850, 000 daltons.

6. The composition according to claim 1, wherein said anionic surfactant is selected from the group consisting of alkali and alkaline earth metal salts of fatty carboxylic acids, alkali and alkaline earth metal salts of alkylbenzene sulfonates, and mixtures thereof.

7. The composition according to claim 6, wherein the composition comprises at least 4% of an alkali or alkaline earth metal salt of one or more fatty carboxylic acids.

8. The composition according to claim 1, wherein said cationic polymer and said anionic surfactant are present at a ratio of less than 1:4.

9. The composition according to claim 1, wherein the composition is a detergent or fabric softener.

10. The composition according to claim 1, having a delta E of less than 12.

11. The composition according to claim 1 which is substantially free of precipitation.

12. A method for conditioning and cleaning textiles comprising, in no particular order:

a. providing a laundry detergent or fabric softener composition according to claim 1;

b. contacting one or more articles with the composition at one or more points during the laundering process; and c. mechanically tumble-drying or allowing the articles to dry.

13. The method according to claim 12, having a Softening Parameter greater than 70.

14. The method according to claim 12, wherein said cationic polymer is selected from the group consisting of dimethyl diallyl ammonium chloride/acrylamide copolymer, dimethyl diallyl ammonium chloride/acrylic acid/acrylamide terpolymer, vinylpyrrolidone/methyl vinyl imidazolium chloride copolymer, polydimethyl diallyl ammonium chloride, starch hydroxypropyl trimmonium chloride, polymethacryl amidopropyl trimethyl ammonium chloride, acrylamidopropyl trimmonium chloride/acrylamide copolymer, guar hydroxypropyl trimonium chloride, hydroxyethyl cellulose derivatized with trimethyl ammonium substituted epoxide, and mixtures thereof.

15. The method according to claim 12, wherein said cationic polymer has a molecular weight of less than 850, 000 daltons.

16. The method according to claim 12, wherein said anionic surfactant is selected from the group consisting of alkali and alkaline earth metal salts of fatty carboxylic acids, alkali and alkaline earth metal salts of alkylbenzene sulfonates, and mixtures thereof.

17. The method according to claim 15, wherein the composition comprises at least 4% of an alkali or alkaline earth metal salt of one or more fatty carboxylic acids.

18. The method according to claim 12, wherein said cationic polymer and said anionic surfactant are present at a ratio of less than 1:4.

19. The method according to claim 12, wherein the composition is a detergent or fabric softener.

20. The method according to claim 12, wherein said amphiphilic carboxy containing polymer is an anionic polyacrylate polymer.

* * * * *